US007866962B2

(12) United States Patent
Newland

(10) Patent No.: US 7,866,962 B2
(45) Date of Patent: Jan. 11, 2011

(54) TWO-STAGE ROTARY COMPRESSOR

(75) Inventor: Joseph A. Newland, Greeneville, TN (US)

(73) Assignee: Tecumseh Products Company, Ann Arbor, MI (US)

( * ) Notice: Subject to any disclaimer, the term of this patent is extended or adjusted under 35 U.S.C. 154(b) by 731 days.

(21) Appl. No.: 11/830,169

(22) Filed: Jul. 30, 2007

(65) Prior Publication Data

US 2009/0035166 A1 Feb. 5, 2009

(51) Int. Cl.
*F04C 23/00* (2006.01)
*F04C 18/344* (2006.01)

(52) U.S. Cl. ..... 418/11; 418/13; 418/15; 418/148; 418/267; 418/268

(58) Field of Classification Search ..... 418/11, 418/13, 7, 8, 15, 148, 248, 267, 268
See application file for complete search history.

(56) References Cited

U.S. PATENT DOCUMENTS

| | | | | |
|---|---|---|---|---|
| 1,983,997 | A | 12/1934 | Rolaff | |
| 2,159,936 | A | 5/1939 | Smith | |
| 2,468,373 | A * | 4/1949 | Makaroff | 418/8 |
| 2,990,109 | A | 6/1961 | Fraser | |
| 3,381,891 | A | 5/1968 | Bellmer | |
| 3,813,193 | A | 5/1974 | Rinehart | |
| 3,981,703 | A | 9/1976 | Glanvall et al. | |
| 4,629,403 | A * | 12/1986 | Wood | 418/1 |
| 4,697,994 | A | 10/1987 | Ishizawa et al. | |
| 5,015,161 | A | 5/1991 | Amin et al. | |
| 5,080,562 | A | 1/1992 | Barrows et al. | |
| 5,135,368 | A | 8/1992 | Amin et al. | |
| 5,240,386 | A | 8/1993 | Amin et al. | |
| 5,284,426 | A | 2/1994 | Strikis et al. | |
| 5,855,474 | A | 1/1999 | Shouman | |
| 5,871,342 | A | 2/1999 | Harte et al. | |
| 6,318,981 | B1 | 11/2001 | Ebara et al. | |
| 6,616,428 | B2 | 9/2003 | Ebara et al. | |
| 6,651,458 | B1 | 11/2003 | Ebara et al. | |
| 6,732,542 | B2 | 5/2004 | Yamasaki et al. | |
| 6,769,267 | B2 | 8/2004 | Ebara et al. | |
| 6,892,454 | B2 | 5/2005 | Matsumoto et al. | |
| 6,907,746 | B2 | 6/2005 | Sato et al. | |
| 6,974,314 | B2 | 12/2005 | Matsumoto et al. | |

(Continued)

FOREIGN PATENT DOCUMENTS

JP 52045717 A * 4/1977

(Continued)

*Primary Examiner*—Thomas E Denion
*Assistant Examiner*—Mary A Davis
(74) *Attorney, Agent, or Firm*—Baker & Daniels LLP

(57) ABSTRACT

A two-stage rotary compressor having a compression mechanism including a single muffler housing member. The single muffler housing member at least partially defines an intermediate pressure discharge cavity and a discharge pressure discharge cavity. In one exemplary embodiment, the compression mechanism includes a cylinder block having a plurality of vanes positioned within slots formed in an inner cylindrical surface of the cylinder block. The slots are in fluid communication with the discharge pressure discharge cavity and receive discharge pressure working fluid to bias the vanes radially inwardly. In another exemplary embodiment, the cylinder block includes a plurality of passages for the delivery of working fluid to and from the cylinder block.

15 Claims, 6 Drawing Sheets

U.S. PATENT DOCUMENTS

| | | | |
|---|---|---|---|
| 7,008,199 | B2 | 3/2006 | Matsumoto et al. |
| 7,101,161 | B2 | 9/2006 | Matsumoto et al. |
| 7,128,540 | B2 | 10/2006 | Tadano et al. |
| 7,131,821 | B2 | 11/2006 | Matumoto et al. |
| 7,168,257 | B2 | 1/2007 | Matsumoto et al. |
| 2004/0151603 | A1 | 8/2004 | Tadano et al. |
| 2004/0165999 | A1 | 8/2004 | Tadano et al. |
| 2006/0216185 | A1 | 9/2006 | Aya et al. |

FOREIGN PATENT DOCUMENTS

| | | | | |
|---|---|---|---|---|
| JP | 55104589 | A | * | 8/1980 |
| JP | 57-38691 | | | 3/1982 |
| JP | 02136588 | A | * | 5/1990 |
| JP | 2006152950 | A | * | 6/2006 |

* cited by examiner

TWO-STAGE ROTARY COMPRESSOR

BACKGROUND

1. Field of the Invention

The present invention relates to rotary compressors and, particularly, to two-stage rotary compressors.

2. Description of the Related Art

Rotary compressors generally include a compression mechanism mounted within a hermetic housing. An eccentric portion of a crankshaft is mounted within the compression mechanism. The crankshaft is rotated by a motor to in turn rotate a roller on the eccentric portion of the crankshaft within the compression chamber to compress a working fluid received by the compression chamber from a suction pressure to a higher discharge pressure.

In order to provide additional compression, the compression mechanism may be a two-stage compression mechanism. In a two-stage compression mechanism, the compression mechanism has two, discrete compression chambers. The first compression chamber receives working fluid at suction pressure and compresses the working fluid to an intermediate pressure. The second compression chamber then receives the previously compressed working fluid at intermediate pressure and compresses the working fluid to a higher discharge pressure. By utilizing a two-stage compression mechanism, the overall efficiency of the compressor may be increased.

SUMMARY OF THE PRESENT INVENTION

The present invention relates to rotary compressors and, particularly, to two-stage rotary compressors. In one embodiment, the present invention provides a two-stage rotary compressor having a compression mechanism including a single muffler housing member. The single muffler housing member at least partially defines both an intermediate pressure discharge cavity and a discharge pressure discharge cavity. The intermediate pressure discharge pressure cavity is in fluid communication with a first compression chamber of the compression mechanism and receives working fluid at intermediate pressure from the first compression mechanism. The discharge pressure discharge cavity is in fluid communication with a second compression chamber of the compression mechanism and receives working fluid at discharge pressure from the second compression chamber. Advantageously, the use of a single muffler housing member eliminates the need to manufacture independent muffler housing members to independently receive working fluid from the first and second compression chambers, and decreases the overall profile or height of the compression mechanism. This, in turn, reduces manufacturing and labor costs and simplifies the assembly of the compressor.

In another exemplary embodiment, the compression mechanism includes a cylinder block having a plurality of vanes positioned within slots formed in an inner cylindrical surface of the cylinder block. The vanes are biased toward the eccentric of a crankshaft received within the cylinder block to form the first and second compression chambers of the compression mechanism. In this embodiment, the muffler housing member further includes the plurality of passages in fluid communication with both the discharge pressure discharge cavity and the slots formed in the cylinder block. In one exemplary embodiment, the passages are in fluid communication with the slots at a point spaced radially outwardly from the vanes. As a result, working fluid at discharge pressure, which may be mixed with lubricating oil, is directed to the backside of the vanes to bias the vanes into firm engagement with the eccentric of the crankshaft. Additionally, the working fluid also functions to deliver oil to the backside of the vanes and decrease frictional contact between the vanes and cylinder block during reciprocation of the vanes.

In another exemplary embodiment, the cylinder block includes a plurality of passages for the delivery of working fluid to and from the cylinder block. In one exemplary embodiment, the cylinder block includes a fluid inlet for the receipt of working fluid at suction pressure, a second fluid inlet for receipt of working fluid at intermediate pressure, and an outlet in communication with one of the first and second compression chambers. In prior compressors having fluid inlets and outlets in different components of the compression mechanism, the tolerance of the components must be closely matched and the components precisely aligned in order to connect the inlets and outlets to outside tubing. This increases the cost of manufacturing the components and assembling the same. Advantageously, by providing both fluid inlets and a fluid outlet in the cylinder block, the inlets and outlet are easily positioned and aligned with the outside tubing by altering the position of a single component.

In one form thereof, the present invention provides a rotary compressor, including: a motor; a crankshaft operably coupled to the motor whereby operation of the motor rotates the crankshaft, the crankshaft having an eccentric portion; a roller positioned on the eccentric portion, the roller defining an outer cylindrical surface; a cylinder block having an inner cylindrical surface including a plurality of slots formed therein, the inner cylindrical surface defining a substantially cylindrical cavity, the eccentric portion of the crankshaft being rotatably disposed within the cylinder block, wherein the outer cylindrical surface of the roller contacts the inner cylindrical surface of the cylinder block; a first vane positioned at least partially within one of the plurality of slots of the cylinder block, the first vane biased inwardly to contact the outer cylindrical surface of the roller; a second vane positioned at least partially within another of the plurality of slots of the cylinder block, the second vane biased inwardly to contact the outer cylindrical surface of the roller; a first compression chamber defined by the first vane, the second vane, the cylinder block, and the roller, in which a working fluid is compressed from a suction pressure to an intermediate pressure; a second compression chamber defined by the first vane, the second vane, the cylinder block, and the roller, in which a working fluid is compressed from the intermediate pressure to a discharge pressure; and a single muffler housing member at least partially defining an intermediate pressure discharge cavity and a discharge pressure discharge cavity, the intermediate pressure discharge cavity in fluid communication with the first compression chamber and the discharge pressure discharge cavity in fluid communication with the second compression chamber.

In another form thereof, the present invention provides a rotary compressor, including: a motor; a crankshaft operably coupled to the motor whereby operation of the motor rotates the crankshaft, the crankshaft having an eccentric portion; a roller positioned on the eccentric portion, the roller defining an outer cylindrical surface; a cylinder block having an inner cylindrical surface including a plurality of slots formed therein, the inner cylindrical surface defining a substantially cylindrical cavity, the eccentric portion of the crankshaft being rotatably disposed within the cylinder block, wherein the outer cylindrical surface of the roller contacts the inner cylindrical surface of the cylinder block; a first vane positioned at least partially within one of the plurality of slots of the cylinder block, the first vane biased inwardly to contact the outer cylindrical surface of the roller; a second vane positioned at least partially within another of the plurality of slots of the cylinder block, the second vane biased inwardly to contact the outer cylindrical surface of the roller; a first compression chamber defined by the first vane, the second vane, the cylinder block, and the roller, in which a working fluid is compressed from a suction pressure to an intermediate pressure; a second compression chamber defined by the first vane, the second vane, the cylinder block, and the roller, in which a working fluid is compressed from the intermediate pressure to a discharge pressure; a main bearing at least partially defining a discharge pressure discharge cavity in fluid communication with the second compression chamber; and a plurality of passages in respective fluid communication with the discharge pressure cavity and with the plurality of slots of the cylinder block, wherein during operation of the compressor, working fluid at discharge pressure is communicated from the discharge cavity to the plurality of slots of the cylinder block to bias the vanes into engagement with the outer cylindrical surface of the roller.

In yet another form thereof, the present invention provides a rotary compressor, including: a motor; a crankshaft operably coupled to the motor whereby operation of the motor rotates the crankshaft, the crankshaft having an eccentric portion; a roller positioned on the eccentric portion, the roller defining an outer cylindrical surface; a cylinder block having an inner cylindrical surface including a plurality of slots formed therein, the inner cylindrical surface defining a substantially cylindrical cavity, the eccentric portion of the crankshaft being rotatably disposed within the cylinder block, wherein the outer cylindrical surface of the roller contacts the inner cylindrical surface of the cylinder block; a first vane positioned at least partially within one of the plurality of slots of the cylinder block, the first vane biased inwardly to contact the outer cylindrical surface of the roller; a second vane positioned at least partially within another of the plurality of slots of the cylinder block, the second vane biased inwardly to contact the outer cylindrical surface of the roller; a first compression chamber defined by the first vane, the second vane, the cylinder block, and the roller, in which a working fluid is compressed from a suction pressure to an intermediate pressure; a second compression chamber defined by the first vane, the second vane, the cylinder block, and the roller, in which a working fluid is compressed from the intermediate pressure to a discharge pressure; a suction pressure inlet extending through the cylinder block and in fluid communication with the first compression chamber; an intermediate pressure inlet extending through the cylinder block and in fluid communication with the second compression chamber; and an outlet extending through the cylinder block and in fluid communication with one of the first compression chamber and the second compression chamber.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention any manner.

DETAILED DESCRIPTION

Figure 1:
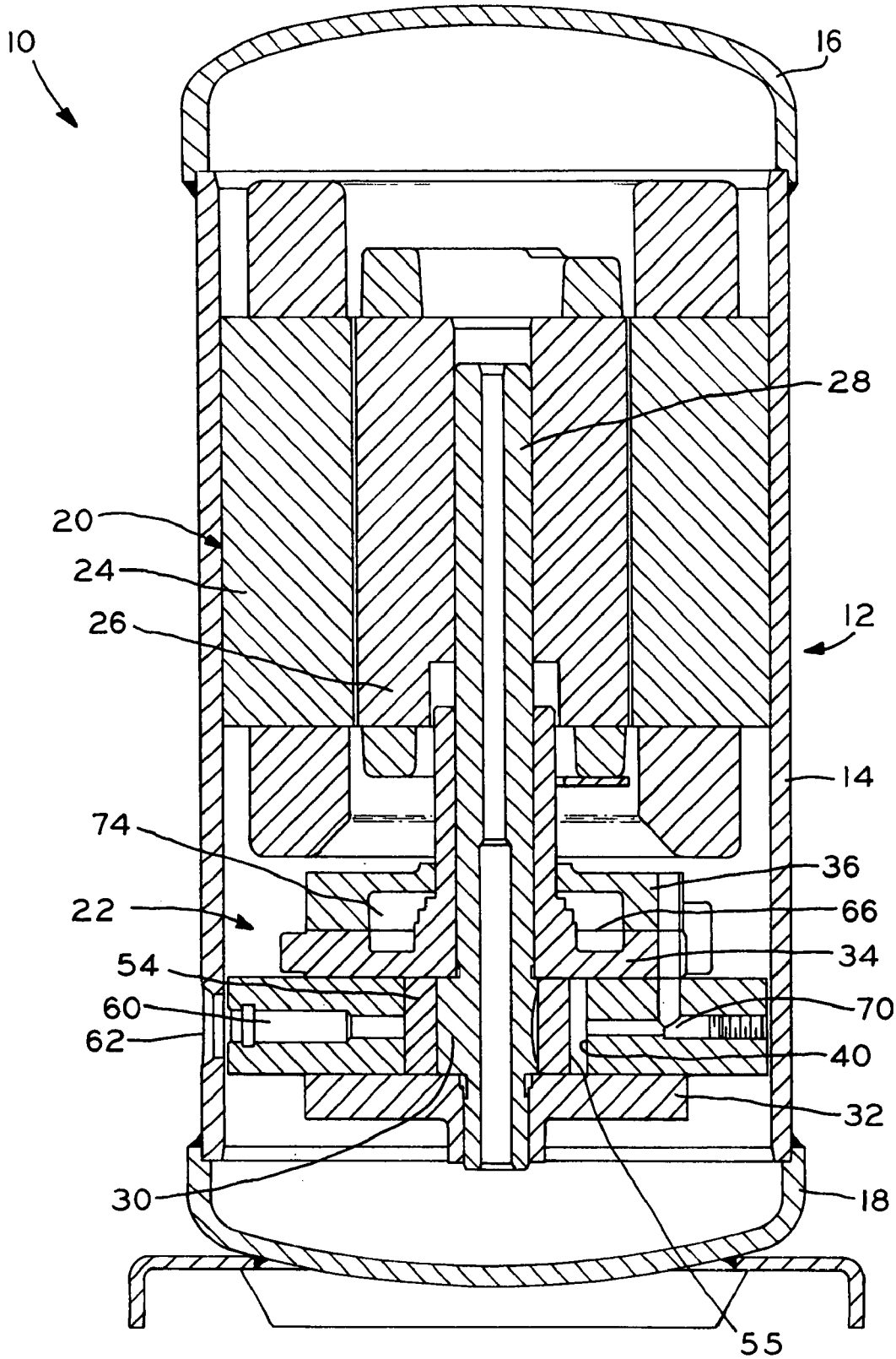
FIG. 1 is a cross-sectional view of a two-stage rotary compressor according to the present invention.
Figure 2A:
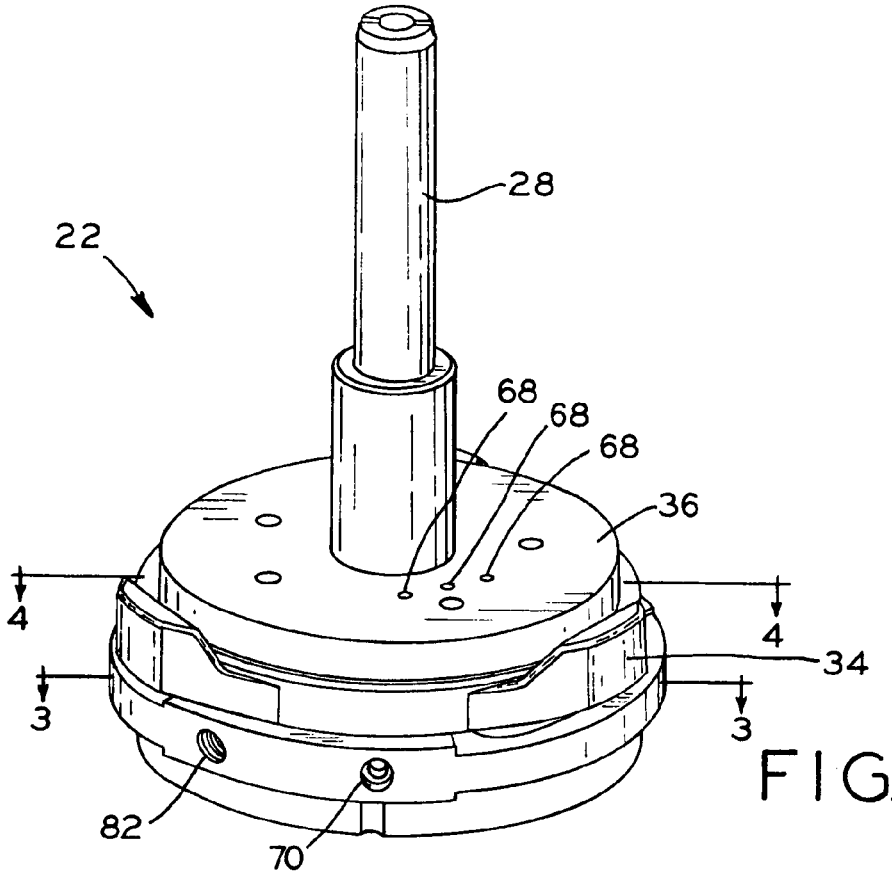
FIG. 2A is a perspective view of the compression mechanism of the compressor of FIG. 1.
Figure 2B:
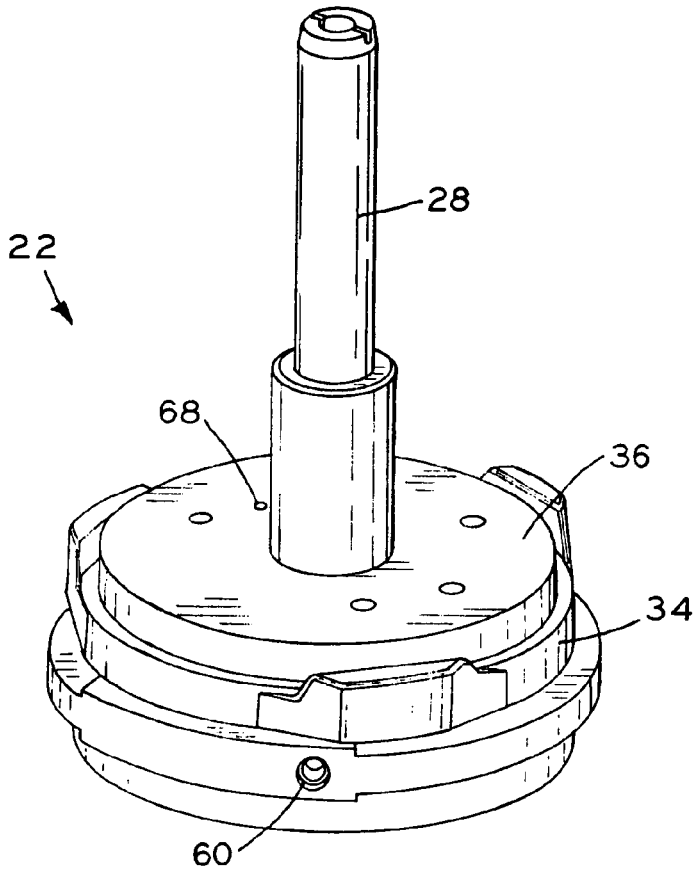
FIG. 2B is a perspective view of the compression mechanism of FIG. 2A rotated 180° from the position shown in FIG. 2A.

Referring to FIG. 1, a cross-section of compressor 10 is shown including hermetic housing 12 having main portion 14 to which upper and lower end caps 16, 18 are connected. In one exemplary embodiment, compressor 10 is a component of a heating and/or cooling circuit, shown schematically in FIG. 6 and described in detail below, and functions to compress a working fluid, such as a refrigerant, which may be an HFC, CFC, HCFC or carbon dioxide refrigerant, for example. Motor 20 and compression mechanism 22 are positioned within hermetic housing 12. Motor 20 includes stator 24 and rotor 26. Crankshaft 28 is coupled to rotor 26 of motor 20, allowing for rotation of crankshaft 28 during operation of motor 20. Crankshaft 28 includes eccentric 30 and is rotatably supported by outboard bearing 32 and main bearing 34 of compression mechanism 22. Muffler housing member 36 of compression mechanism 22 is positioned above main bearing 34. Cylinder block 38 of compression mechanism 22 is positioned between outboard bearing 32 and main bearing 34. Outboard bearing 32, cylinder block 38, main bearing 34, and muffler housing member 36 may be connected together by fasteners, such as bolts.

Figure 3:
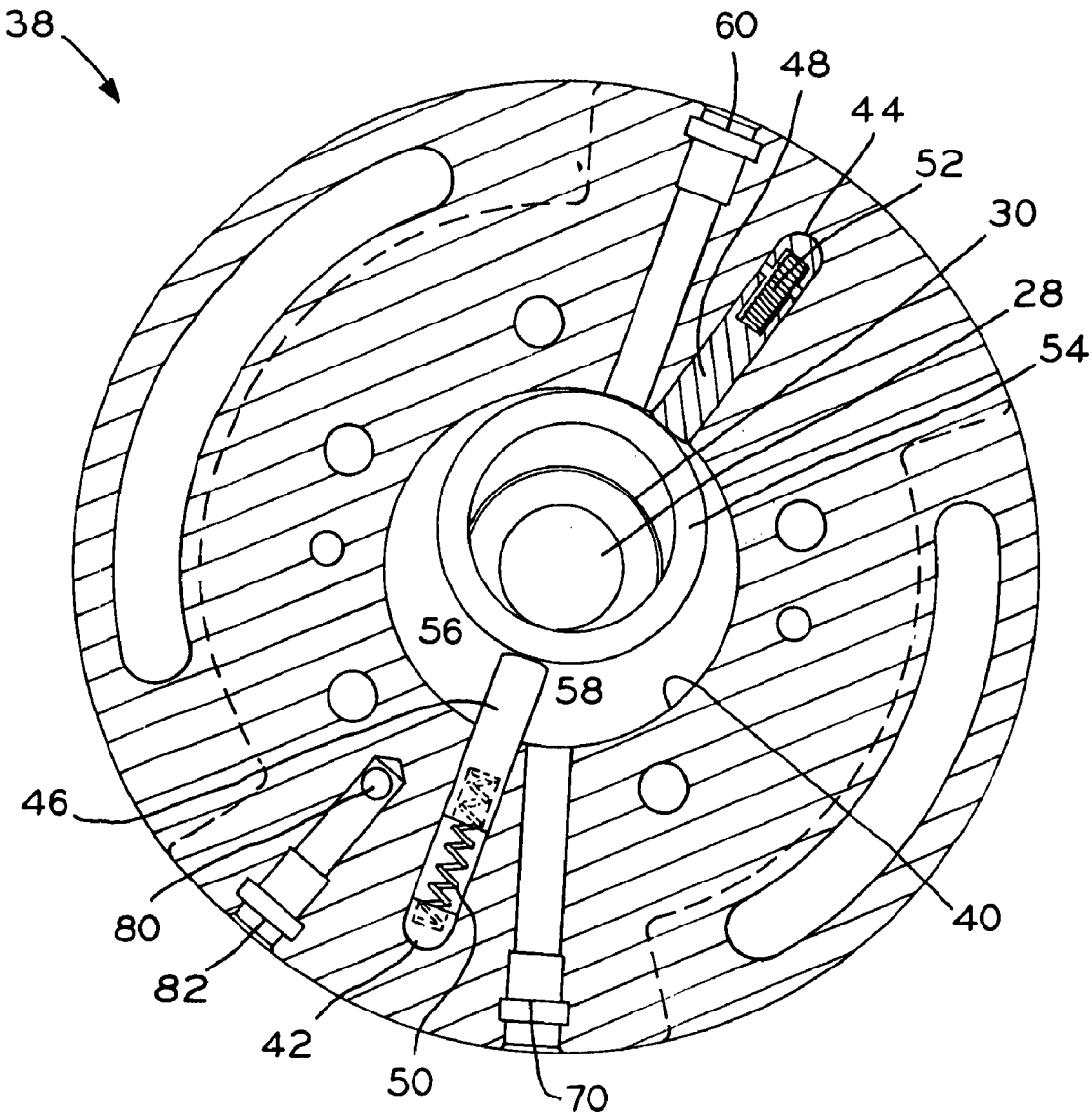
FIG. 3 is a cross-sectional view of the compression mechanism of FIG. 2A, taken along line 3-3 of FIG. 2A.
Figure 4:
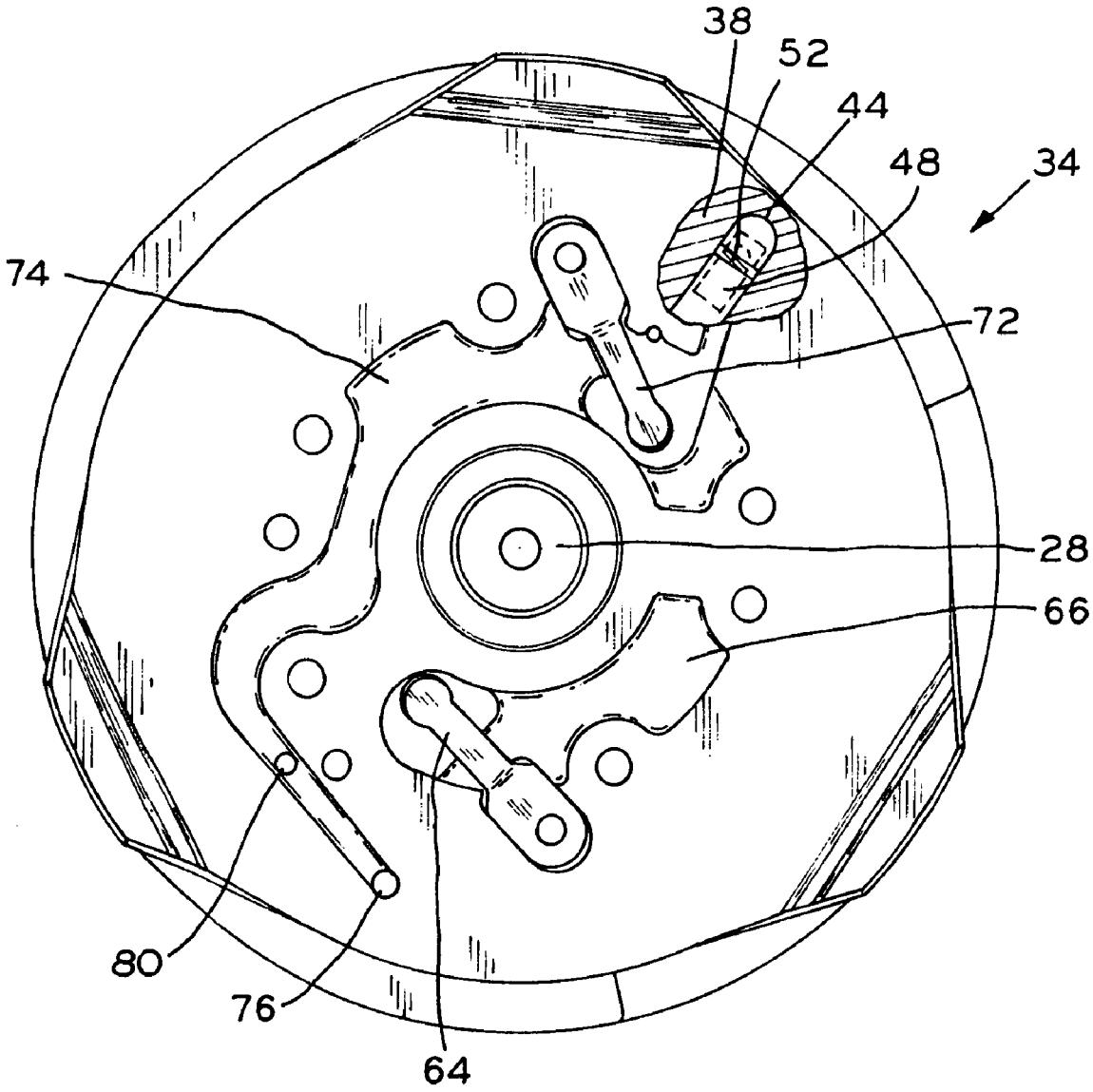
FIG. 4 is a cross-sectional view of the compression mechanism of FIG. 2A, taken along line 4-4 of FIG. 2A.

Referring to FIG. 3, cylinder block 38 includes inner cylindrical surface 40 defining a cylindrical cavity for receipt of eccentric 30 of crankshaft 28. Inner cylindrical surface 40 includes slots 42, 44 formed therein. Vanes 46, 48 are positioned at least partially within slots 42, 44. Biasing members, such as springs 50, 52, are disposed within the slots and bias vanes 46, 48 radially inwardly to contact outer cylindrical surface 55 of roller 54. Roller 54 is positioned around eccentric 30 of crankshaft 28 and defines outer cylindrical surface 55. Outer cylindrical surface 55 of roller 54 is in contact with inner cylindrical surface 40 of cylinder block 38. During operation of compressor 10, crankshaft 28 drives roller 54 eccentrically while maintaining constant contact with inner cylindrical surface 40 to compress a working fluid, as described in detail below.

Figure 5:
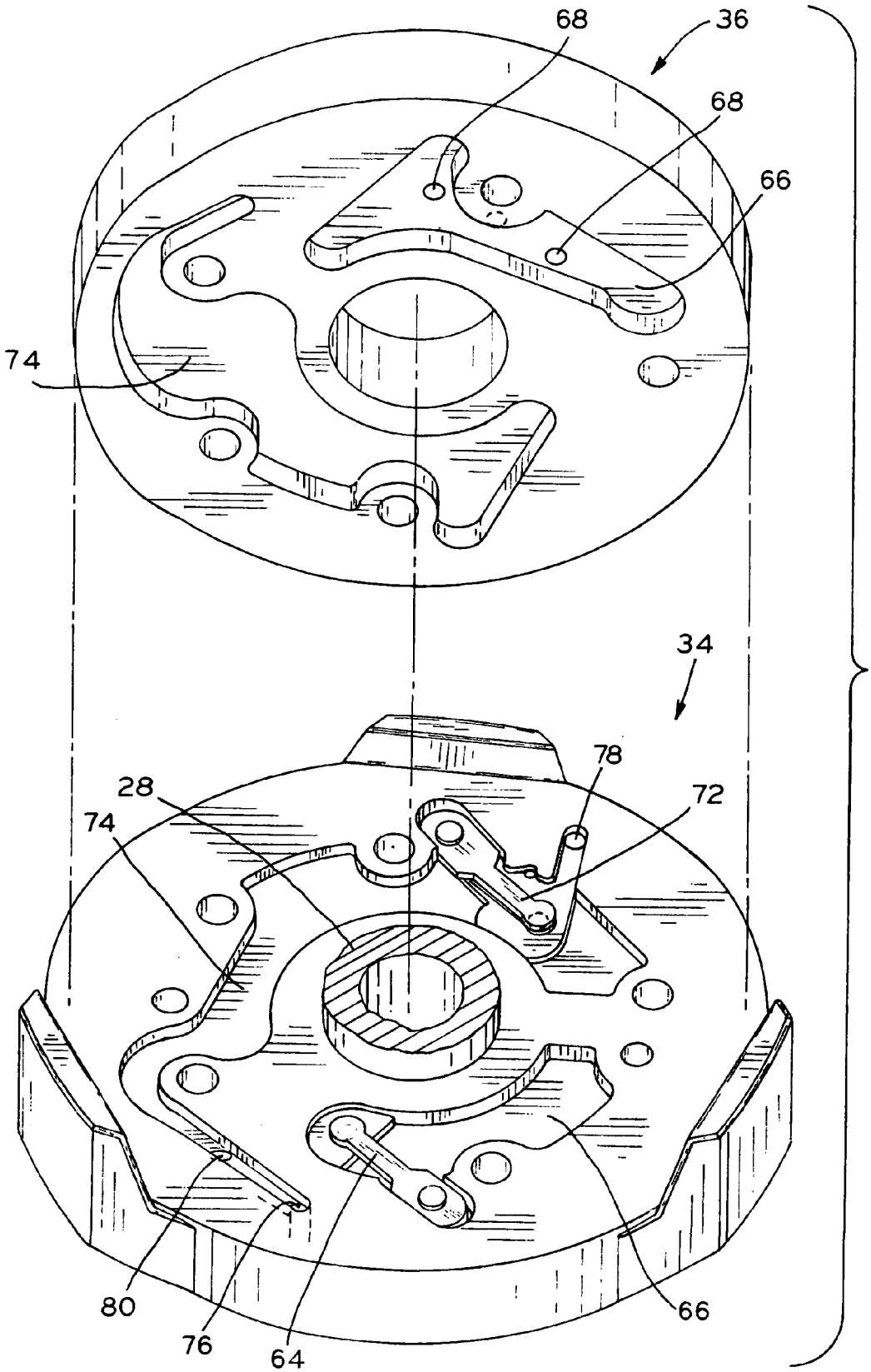
FIG. 5 is an exploded perspective view of the main bearing and single muffler housing member of the compression mechanism of FIG. 2A.

Referring to FIG. 3, cylinder block 38, vanes 46, 48, and roller 54 cooperate to define a pair of compression chambers 56, 58. Compression chamber 56 is a first stage compression chamber into which working fluid at suction pressure is drawn through suction pressure inlet 60. Suction pressure inlet 60 extends through cylinder block 38 and is in communication with opening 62 (FIG. 1) in main portion 14 of hermetic housing 12 to receive working fluid from pipe 63, shown schematically in FIG. 6. Working fluid received via suction pressure inlet 60 enters compression chamber 56 and is compressed to an intermediate pressure by the rotation of eccentric 30 and roller 54. Specifically, as eccentric 30 and roller 54 are rotated, the volume of compression chamber 56 is reduced, compressing the working fluid between vane 46, roller 54, and inner cylindrical surface 40 of cylinder block 38. Once the working fluid has reached the intermediate pressure, valve 64, shown in FIG. 5, is forced away from main bearing 34 to allow working fluid to enter intermediate pressure discharge cavity 66 defined entirely by main bearing 34 and muffler housing member 36. The intermediate pressure working fluid then exits compression mechanism 22 via discharge ports 68 in muffler housing member 36 and enters the interior of hermetic housing 12 of compressor 10.

Figure 6:
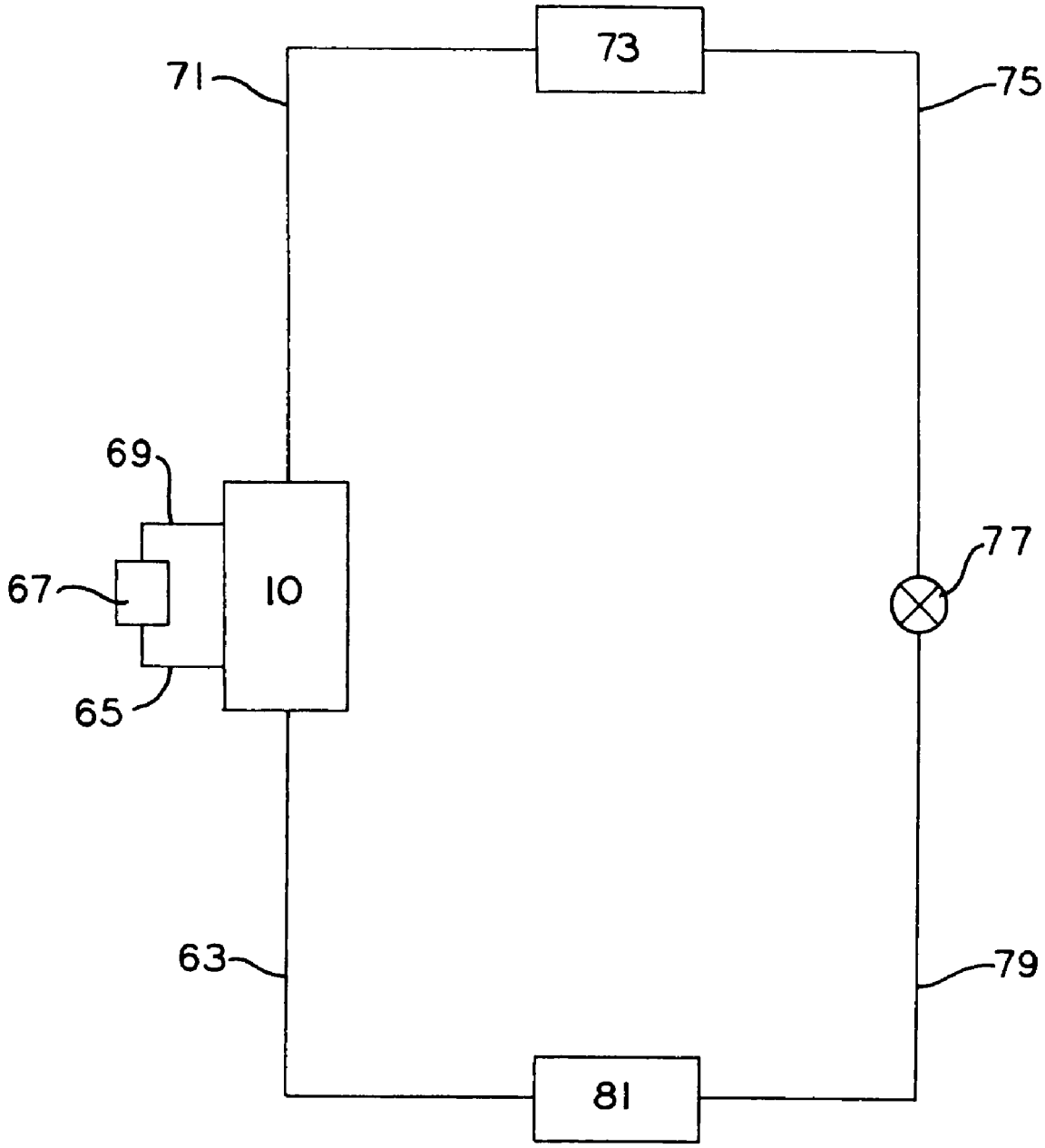
FIG. 6 is a schematic of a heating and/or cooling circuit including the compressor of FIG. 1.

In one exemplary embodiment, shown in FIG. 6, compressor 10 is a component of a heating and/or cooling circuit including intercooler 67. In this embodiment, intermediate pressure working fluid exits compressor 10 via an outlet (not shown) in hermetic housing 12 and travels through pipe 65 to arrive at intercooler 67. Intercooler 67 is used to dissipate heat from the intermediate pressure working fluid into the ambient environment, increasing the volumetric efficiency of compressor 10 during the second stage of compression, described below. Once the working fluid has been cooled by passing through intercooler 67, the intermediate pressure working fluid passes through pipe 69 and enters into compression chamber 58 via intermediate pressure inlet 70.

In another exemplary embodiment, intercooler 67 and pipes 65, 69 are absent. In this embodiment, the intermediate pressure working fluid is discharged into and retained within hermetic housing 12. The intermediate pressure working fluid is then drawn into compression chamber 58 from the interior of hermetic housing 12. Specifically, compression chamber 58 is a second stage compression chamber into which working fluid at intermediate pressure is drawn through intermediate pressure inlet 70. Once within compression chamber 58, rotation of eccentric 30 and roller 54 compresses the intermediate pressure working fluid to a higher discharge pressure. Specifically, as eccentric 30 and roller 54 are rotated, the volume of compression chamber 58 is reduced, compressing the working fluid between vane 48, roller 54, and inner cylindrical surface 40 of cylinder block 38. Referring to FIG. 5, once compressed, the discharge pressure working fluid forces valve 72 away from main bearing 34 to allow the discharge pressure working fluid to enter discharge pressure discharge cavity 74, which is entirely defined between main bearing 34 and muffler housing member 36. Discharge pressure discharge cavity 74 is in fluid communication with passageways 76, 78, which are in fluid communication with slots 42, 44 formed in cylinder block 38, as shown in FIG. 3.

Due to the fluid communication between discharge pressure discharge cavity 74 and slots 42, 44, discharge pressure working fluid is received within slots 42, 44. In one exemplary embodiment, passageways 76, 78 provide working fluid to slots 42, 44 at positions spaced radially outwardly from vanes 46, 48. In this embodiment, the discharge pressure working fluid exerts a force to the backside of vanes 46, 48 to bias vanes 46, 48 radially inwardly and into engagement with roller 54. Due to the biasing force of the discharge pressure working fluid, in conjunction with the baising means positioned within slots 42, 44, vanes 46, 48 are biased toward roller 54 with a sufficient force to maintain contact with roller 54 at substantially all times during operation of compressor 10. As a result, any leakage of working fluid between compression chambers 56, 58 is minimized or eliminated. Additionally, in one exemplary embodiment, oil is mixed with the working fluid. By placing oil in the working fluid, the working fluid provides lubrication to the various components of the compressor and/or other components of a heating and/or cooling circuit as it passes therethrough. Thus, the receipt of working fluid containing oil within slots 42, 44 provides lubrication to slots 42, 44 and, correspondingly, vanes 46, 48, lessening the friction experienced during reciprocation of vanes 46, 48 within slots 42, 44.

In addition to passageways 76, 78, discharge pressure discharge cavity 74 further includes outlet 80 in fluid communication with discharge pressure outlet 82 extending through cylinder block 38. While outlet 82 is described and depicted herein as a discharge pressure outlet, outlet 82 may be in fluid communication with intermediate pressure discharge cavity 66 and, correspondingly, compression chamber 56, to form an intermediate discharge pressure outlet. Referring to FIG. 6, discharge pressure working fluid exists outlet 82 and compressor 10 via an outlet (not shown) in hermetic housing 12, and travels therethrough to condenser 73. As discharge pressure working fluid travels through condenser 73, heat is released from the discharge pressure working fluid into the ambient environment as the working fluid changes phase from a gas to a liquid. As the working fluid exits condenser 73 it passes through pipe 75 and travels through expansion valve 77, where the pressure of the working fluid is reduced. The working fluid then travels through pipe 79 to arrive at evaporator 81. As the working fluid travels through evaporator 81, it absorbs heat from the ambient environment and is vaporized, changing back to the gas phase. Once in the gas phase, the working fluid is drawn through pipe 63 passing through opening 62 in hermetic housing 12 to arrive at suction pressure inlet 60. Once received through suction pressure inlet 60, the working fluid is compressed by compression mechanism 22, as described in detail above, and the process repeated.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A rotary compressor, comprising:

an outer hermetic housing defining an interior space;

a motor;

a crankshaft operably coupled to said motor whereby operation of said motor rotates said crankshaft, said crankshaft having an eccentric portion;

a roller positioned on said eccentric portion, said roller defining an outer cylindrical surface;

a cylinder block having an inner cylindrical surface including a plurality of slots formed therein, said inner cylindrical surface defining a substantially cylindrical cavity, said eccentric portion of said crankshaft being rotatably disposed within said cylinder block, wherein said outer cylindrical surface of said roller contacts said inner cylindrical surface of said cylinder block;

a first vane positioned at least partially within one of said plurality of slots of said cylinder block, said first vane biased inwardly to contact said outer cylindrical surface of said roller;

a second vane positioned at least partially within another of said plurality of slots of said cylinder block, said second vane biased inwardly to contact said outer cylindrical surface of said roller;

a first compression chamber defined by said first vane, said second vane, said cylinder block, and said roller, in which a working fluid is compressed from a suction pressure to an intermediate pressure;

a second compression chamber defined by said first vane, said second vane, said cylinder block, and said roller, in which a working fluid is compressed from the intermediate pressure to a discharge pressure; and a muffler housing member disposed on only one axial side of said cylinder block and at least partially defining an intermediate pressure discharge cavity and a discharge pressure discharge cavity, said intermediate pressure discharge cavity in fluid communication with said first compression chamber and said discharge pressure discharge cavity in fluid communication with said second compression chamber, said intermediate pressure discharge cavity and said discharge pressure discharge cavity being disposed on said one axial side of said cylinder block and being separate from the interior space of the hermetic housing.

2. The rotary compressor of claim 1, wherein said intermediate pressure discharge cavity is in fluid communication with said interior of said hermetic housing.

3. The rotary compressor of claim 1, and including a bearing disposed on said one axial side of said cylinder block and defining with said muffler housing member said intermediate pressure discharge cavity and said discharge pressure discharge cavity.

4. The rotary compressor of claim 3, wherein said bearing and said muffler housing member define the entirety of said intermediate discharge pressure cavity and said discharge pressure discharge cavity.

5. A rotary compressor, comprising:

a motor;

a crankshaft operably coupled to said motor whereby operation of said motor rotates said crankshaft, said crankshaft having an eccentric portion;

a roller positioned on said eccentric portion, said roller defining an outer cylindrical surface;

a cylinder block having an inner cylindrical surface including a plurality of slots formed therein, said inner cylindrical surface defining a substantially cylindrical cavity, said eccentric portion of said crankshaft being rotatably disposed within said cylinder block, wherein said outer cylindrical surface of said roller contacts said inner cylindrical surface of said cylinder block;

a first vane positioned at least partially within one of said plurality of slots of said cylinder block, said first vane biased inwardly to contact said outer cylindrical surface of said roller;

a second vane positioned at least partially within another of said plurality of slots of said cylinder block, said second vane biased inwardly to contact said outer cylindrical surface of said roller;

a first compression chamber defined by said first vane, said second vane, said cylinder block, and said roller, in which a working fluid is compressed from a suction pressure to an intermediate pressure;

a second compression chamber defined by said first vane, said second vane, said cylinder block, and said roller, in which a working fluid is compressed from the intermediate pressure to a discharge pressure;

a muffler housing member at least partially defining an intermediate pressure discharge cavity and a discharge pressure discharge cavity, said intermediate pressure discharge cavity in fluid communication with said first compression chamber and said discharge pressure discharge cavity in fluid communication with said second compression chamber; and a bearing at least partially defining said intermediate pressure discharge cavity and said discharge pressure discharge cavity.

6. The rotary compressor of claim 5, wherein said bearing and said muffler housing member define the entirety of said intermediate discharge pressure cavity and said discharge pressure discharge cavity.

7. The rotary compressor of claim 5, wherein said bearing further comprises a plurality of passageways, each of said plurality of passageways in fluid communication with a respective one of said plurality of slots in said cylinder block.

8. A rotary compressor, comprising:

a motor;

a crankshaft operably coupled to said motor whereby operation of said motor rotates said crankshaft, said crankshaft having an eccentric portion;

a roller positioned on said eccentric portion, said roller defining an outer cylindrical surface;

a cylinder block having an inner cylindrical surface including a plurality of slots formed therein, said inner cylindrical surface defining a substantially cylindrical cavity, said eccentric portion of said crankshaft being rotatably disposed within said cylinder block, wherein said outer cylindrical surface of said roller contacts said inner cylindrical surface of said cylinder block;

a first vane positioned at least partially within one of said plurality of slots of said cylinder block, said first vane biased inwardly to contact said outer cylindrical surface of said roller;

a second vane positioned at least partially within another of said plurality of slots of said cylinder block, said second vane biased inwardly to contact said outer cylindrical surface of said roller;

a first compression chamber defined by said first vane, said second vane, said cylinder block, and said roller, in which a working fluid is compressed from a suction pressure to an intermediate pressure;

a second compression chamber defined by said first vane, said second vane, said cylinder block, and said roller, in which a working fluid is compressed from the intermediate pressure to a discharge pressure;

a main bearing at least partially defining a discharge pressure discharge cavity in fluid communication with said second compression chamber;

a hermetic housing defining an interior space at a pressure lower than discharge pressure, said discharge pressure discharge cavity being fluidly isolated from said housing interior space; and a plurality of passages in respective fluid communication with said discharge pressure discharge cavity and with said plurality of slots of said cylinder block, wherein during operation of the compressor, working fluid at discharge pressure is communicated from said discharge pressure discharge cavity to said plurality of slots of said cylinder block to bias said vanes into engagement with said outer cylindrical surface of said roller.

9. The rotary compressor of claim 8, wherein said plurality of passages extend through said main bearing.

10. The rotary compressor of claim 8, further comprising a muffler housing member at least partially defining said discharge pressure discharge cavity, wherein said muffler housing member and said main bearing define the entirety of said discharge pressure discharge cavity.

11. The rotary compressor of claim 8, further comprising a discharge pressure outlet in fluid communication with said discharge pressure discharge cavity.

12. The rotary compressor of claim 11, wherein said discharge pressure outlet extends through said cylinder block.

13. A rotary compressor, comprising:

a motor;

a crankshaft operably coupled to said motor whereby operation of said motor rotates said crankshaft about an axis, said crankshaft having an eccentric portion;

a roller positioned on said eccentric portion, said roller defining an outer cylindrical surface;

a cylinder block having an inner cylindrical surface including a plurality of slots formed therein, said inner cylindrical surface defining a substantially cylindrical cavity, said eccentric portion of said crankshaft being rotatably disposed within said cylinder block, wherein said outer cylindrical surface of said roller contacts said inner cylindrical surface of said cylinder block;

a first vane positioned at least partially within one of said plurality of slots of said cylinder block, said first vane biased inwardly to contact said outer cylindrical surface of said roller;

a second vane positioned at least partially within another of said plurality of slots of said cylinder block, said second vane biased inwardly to contact said outer cylindrical surface of said roller;

a first compression chamber defined by said first vane, said second vane, said cylinder block, and said roller, in which a working fluid is compressed from a suction pressure to an intermediate pressure;

a second compression chamber defined by said first vane, said second vane, said cylinder block, and said roller, in which a working fluid is compressed from the intermediate pressure to a discharge pressure;

an elongate suction pressure inlet extending radially through said cylinder block and in fluid communication with said first compression chamber;

an elongate intermediate pressure inlet extending radially through said cylinder block and in fluid communication with said second compression chamber; and an elongate outlet extending radially through said cylinder block and in fluid communication with one of said first compression chamber and said second compression chamber.

14. The rotary compressor of claim 13, wherein said outlet is in fluid communication with said second compression chamber.

15. The rotary compressor of claim 13, wherein said outlet is in fluid communication with said first compression chamber.

* * * * *